US006202717B1

(12) United States Patent
Markey et al.

(10) Patent No.: US 6,202,717 B1
(45) Date of Patent: Mar. 20, 2001

(54) DISPENSING BOTTLE CLOSURE

(75) Inventors: Kevin J. Markey, Brookfield; John A. Boticki, Racine, both of WI (US)

(73) Assignee: S. C. Johnson Commercial Markets, Inc., Sturtevant, WI (US)

( * ) Notice: Subject to any disclaimer, the term of this patent is extended or adjusted under 35 U.S.C. 154(b) by 0 days.

(21) Appl. No.: 09/368,986

(22) Filed: Aug. 5, 1999

(51) Int. Cl.[7] ..... B65B 1/04; B65B 3/00; B67C 3/00

(52) U.S. Cl. ..... 141/383; 141/311 R; 141/346; 141/347; 141/348; 141/349; 141/386; 215/211; 215/216; 215/307; 251/149.6

(58) Field of Search ..... 141/346–350, 141/383–386, 311 R; 251/149.6, 149.7; 215/43, 44, 211, 216, 217, 307, 311, 315; 220/288, 303, 373

(56) References Cited

U.S. PATENT DOCUMENTS

| | | | | |
|---|---|---|---|---|
| 3,297,187 | | 1/1967 | Thiesen | 215/43 |
| 4,182,388 | * | 1/1980 | Sellen | 141/351 |
| 5,007,588 | | 4/1991 | Chow et al. | 239/318 |
| 5,009,323 | | 4/1991 | Montgomery et al. | 215/252 |
| 5,052,568 | | 10/1991 | Simon | 215/250 |
| 5,100,059 | | 3/1992 | Englhard et al. | 239/310 |
| 5,150,803 | | 9/1992 | Cartellone | 215/357 |
| 5,314,084 | | 5/1994 | Folta et al. | 215/249 |
| 5,383,603 | | 1/1995 | Englhard et al. | 239/314 |
| 5,544,810 | | 8/1996 | Horvath et al. | 239/10 |
| 5,586,673 | | 12/1996 | Venooker et al. | 215/310 |
| 5,676,186 | * | 10/1997 | Vanderploeg | 141/347 |
| 5,836,364 | * | 11/1998 | Burton | 141/348 |
| 5,862,948 | | 1/1999 | Duchon et al. | 222/133 |

* cited by examiner

*Primary Examiner*—Timothy L. Maust
(74) *Attorney, Agent, or Firm*—Neil E. Hamilton; Warren R. Bovee; Renee J. Rymarz

(57) ABSTRACT

A closure member for use with a bottle wherein the bottle is threadably connected to a filling head of an apparatus for diluting and dispensing a concentrated chemical product. The closure member is frictionally fitted into the neck of the bottle and has threads to interconnect the bottle to the filling head. In a preferred manner, the frictional fit between the closure member and the bottle neck is provided by flexible finger members extending from the closure member and a rib member extending from the neck of the bottle. In another preferred manner, the closure member includes a core section for housing a valve body.

11 Claims, 5 Drawing Sheets

DISPENSING BOTTLE CLOSURE

CROSS-REFERENCE TO RELATED APPLICATIONS

NONE.

STATEMENT REGARDING FERERALLY SPONSERED RESEARCH OR DEVELOPMENT

NONE.

BACKGROUND OF THE INVENTION

1. Technical Field

This invention relates to a bottle closure which can provide threads for a bottle. More particularly, it relates to a plug device for a bottle which can interconnect the bottle to a filling head in an apparatus for diluting and dispensing a concentrated chemical product.

2. Background Art

There are available apertured plugs for containers intended to be used in conjunction with fluid mixing devices. One such plug is employed in conjunction with a docking station and bottle system which is the subject of U.S. Pat. No. 5,862,948. A bottle interconnect mechanism 90 in the form of a plug is taught in conjunction with a bottle 22 having threads 96.

Another plug 152 is described in U.S. Pat. No. 5,544,810 and has integral fingers 154 adapted to be snap-engageable with the spout 146 of the container. In U.S. Pat. No. 5,586,673 a fluid delivery system is disclosed with a bottle 40 and a thrust washer 106 with integral fingers 121 adapted to be snap-engageable with a cap 52. The system also includes valve members 58 and 60. In U.S. Pat. 3,297,187 a closure device is described in the form of a cap 2*b* with threads 7*b*. This is employed in a cap-on-cap combination with the second cap 3*b* having a recess 8*b* for fitting into an annular bead 9*b* of the container 1*b*.

In order to manufacture the bottle with the closure plug of the type described in previously referred to U.S. Pat. No. 5,862,948, precise molding is required of the bottle and the plug. This requires in many instances that manufacture take place at a single location in order to control tolerances. A disadvantage of this is that it necessitates the shipment of empty bottles to filling locations.

The prior art does not afford a solution to the problem of providing a bottle interconnect for use with a filling head which obviates having to mold threads on a bottle.

The objects of the invention therefore are:

a. Providing an improved bottle interconnect device.

b. Providing a bottle with a closure wherein the closure has threads for interconnecting the bottle to a filling head.

c. Providing a closure of the foregoing type which is easily connected to a bottle.

d. Providing a closure of the foregoing type which can be economically manufactured.

SUMMARY OF THE INVENTION

The foregoing objects are accomplished and the shortcomings of the prior art are overcome by the bottle of this invention for use with a filling head which includes a bottle having a neck portion with a passage therein and a closure member having a core section which is constructed and arranged to fit within the passage of the neck portion. There are frictional engagement members operatively associated with the closure member and the neck portion to provide retention of the closure member in the neck passage. A wall section is spaced from the core section and there are thread means operatively associated with the wall section. When the closure member is engaged in the neck of the bottle the thread means will provide connection of the bottle to a filling head.

In one aspect, the core section includes a chamber for reception of a valve body.

In a preferred embodiment, the frictional engagement members operatively associated with the closure member are a plurality of flexible finger members having flange sections for engagement with rib members positioned on the neck portion of the bottle.

In another aspect, the flexible finger members are positioned adjacent the wall section.

In another preferred embodiment, a guide assembly is operatively associated with the wall section and the bottle neck to provide orientation of the threads with respect to the bottle.

In yet another preferred embodiment, the guide assembly includes a slot and a projection so that when the projection is placed in the slot, rotation of the closure member with respect to the bottle is prevented.

In still another aspect, a closure member is provided for use with a bottle and a filling head wherein the closure member has threads for connecting the bottle to the filling head.

These and still other objects and advantages of the invention will be apparent from the description which follows. In the detailed description below, a preferred embodiment of the invention will be described in reference to the full scope of the invention. Rather the invention may be employed in other embodiments.

DESCRIPTION OF PREFERRED EMBODIMENTS

Figure 1:
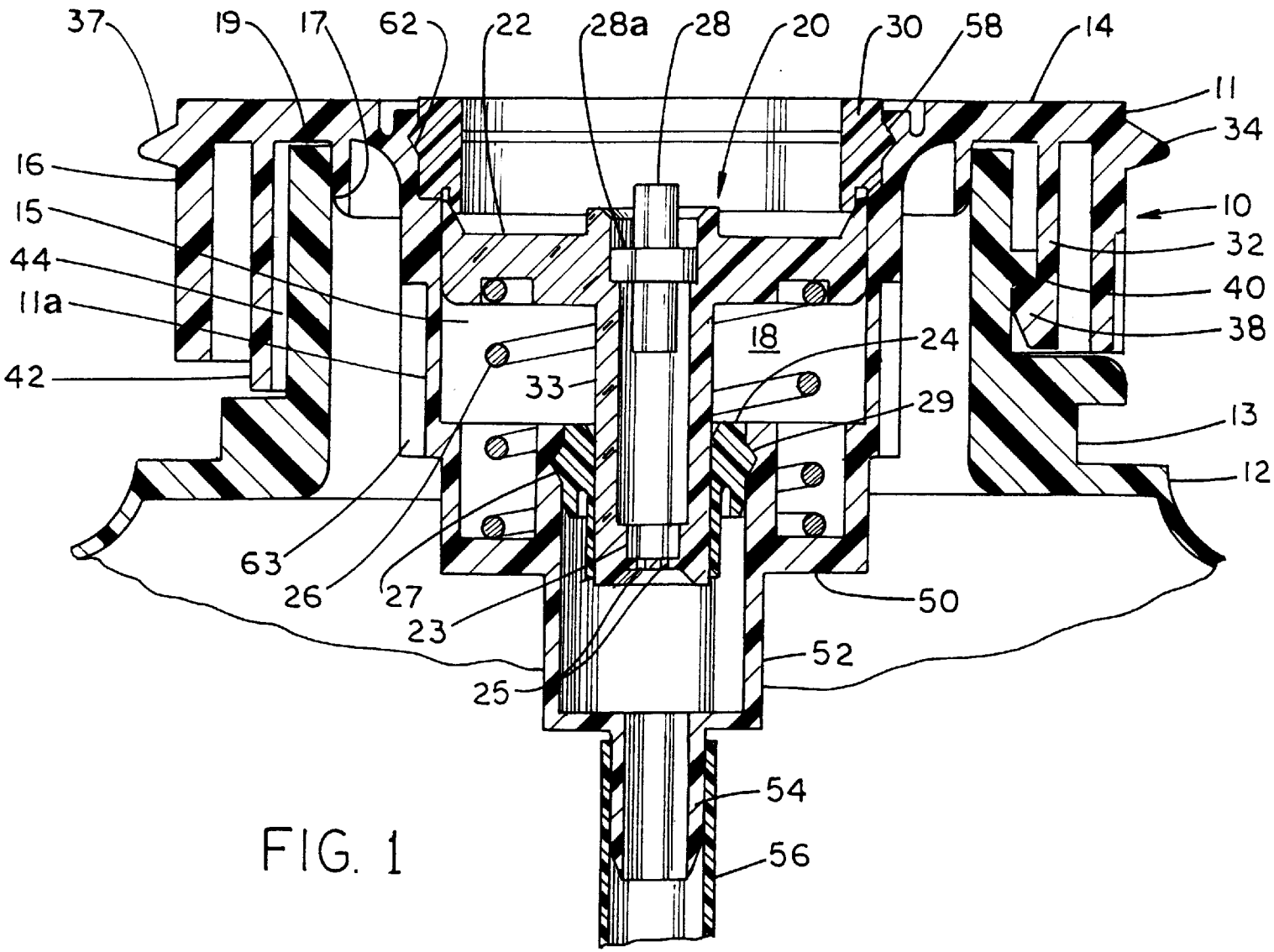
FIG. 1 is a cross-sectional view of the dispensing bottle closure positioned on a bottle.
Figure 2:
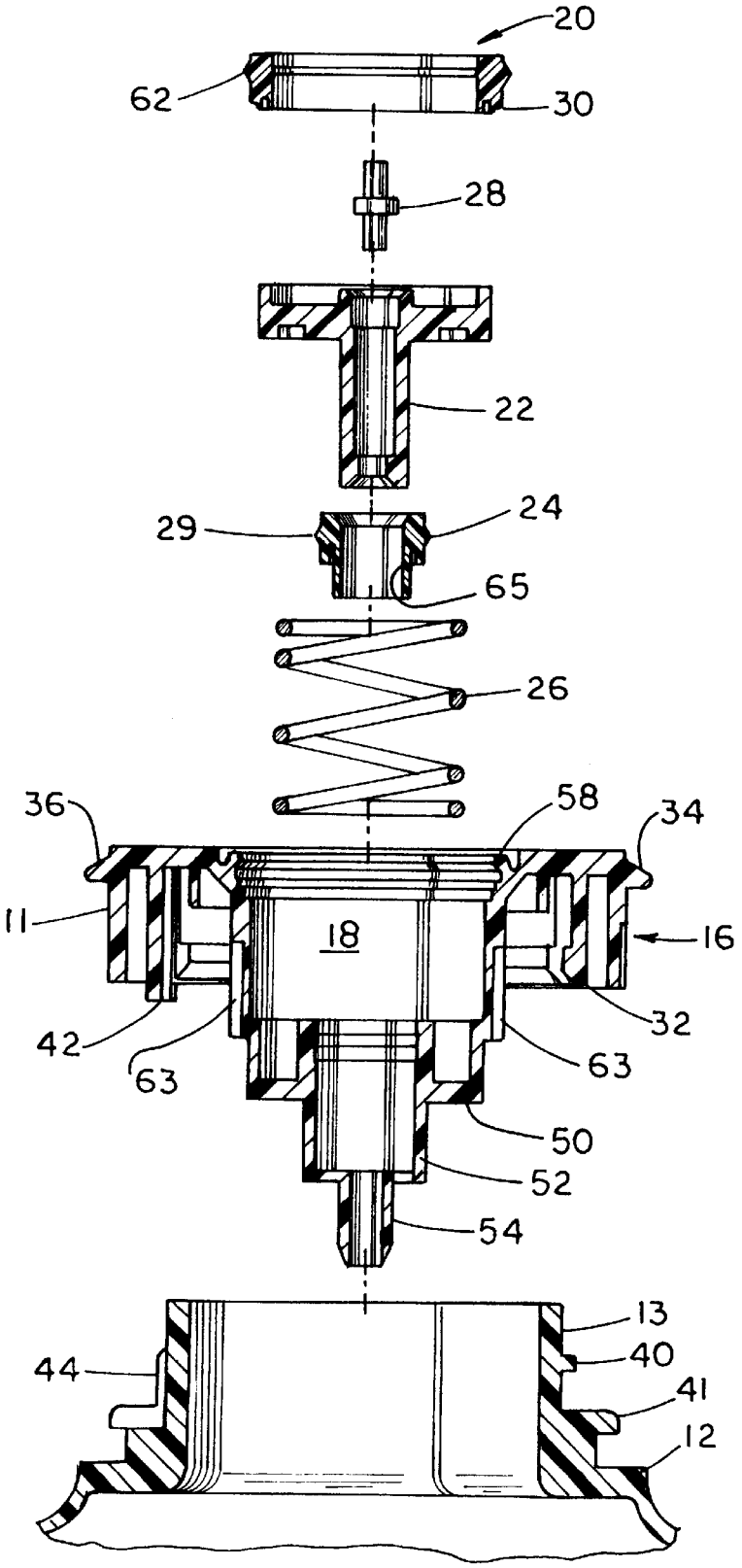
FIG. 2 is an exploded view in cross-section of the dispensing bottle closure shown in FIG. 1.
Figure 3:
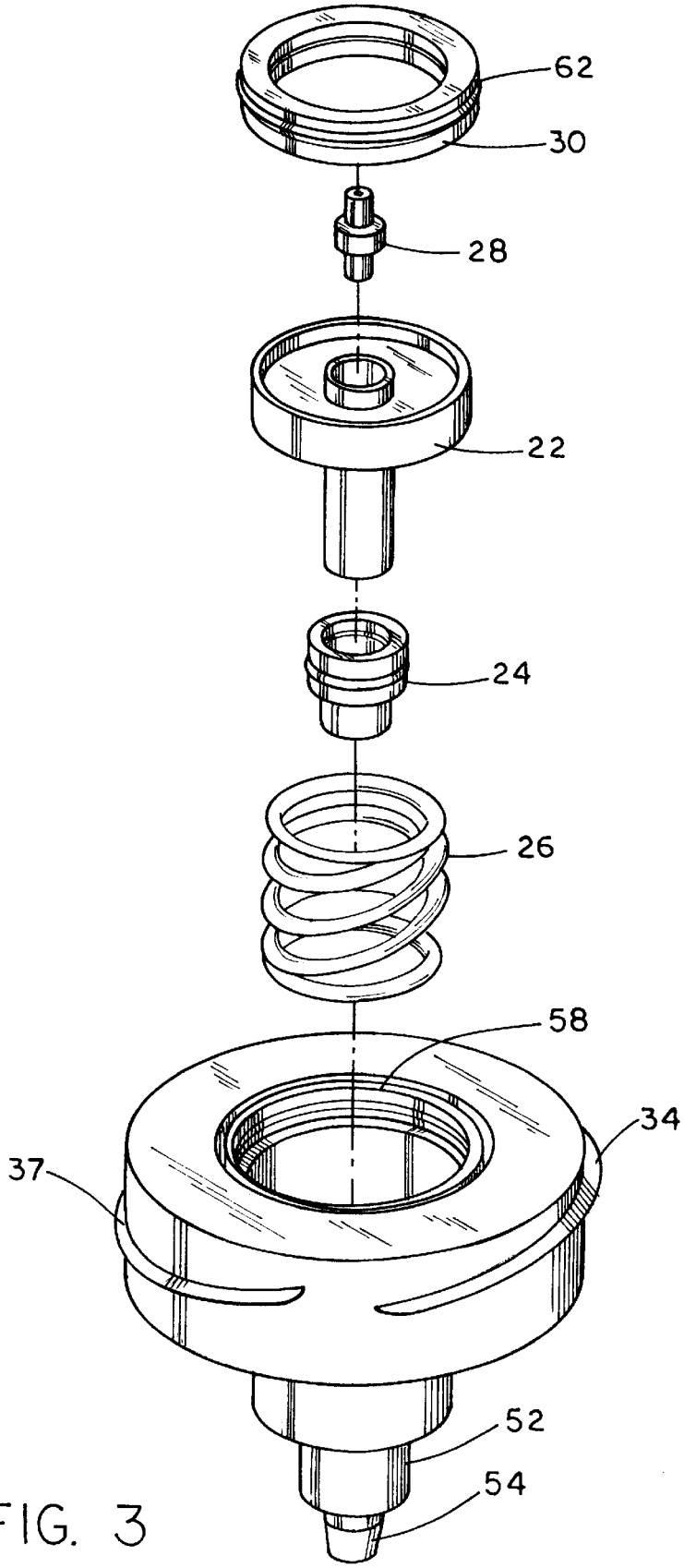
FIG. 3 is a view similar to FIG. 2 showing the component parts in perspective view.

Referring to FIGS. 1–3, the dispensing bottle closure generally 10 includes a cap or plug 11 for positioning on a bottle 12 having a neck 13. The plug 11 includes an end wall 14 and a side wall 16. A core section 18 is provided defining a chamber 15 in the plug and receives a valve assembly generally 20 having a valve member 22 with a tubular portion 23 having passages 25. The valve assembly 20 is generally described in U.S. Pat. No. 5,862,948 which teachings are fully incorporated herein by reference. A valve sleeve 24 is retained in a collar section 52 by the undercut 27 and the sealing bead 29 extending from the sleeve 24. Valve member 22 has a tubular portion 33 slidably received in sleeve 24 and is retained in the core section 18 by a valve retainer 30 which is connected to the plug 11 by the sealing bead 62 and the undercut 58 in the plug 11. A spring 26 rests on base 50 of the plug and against the valve member 22. An orifice restrictor 28 is positioned in the tubular portion 23 of valve member 22 and is frictionally held therein by the collar portion 28*a*. A sealing flap 17 extends from end wall 14 to engage a side of bead wall 19 to provide a seal between plug 11 and the bottle neck.

Figure 7:
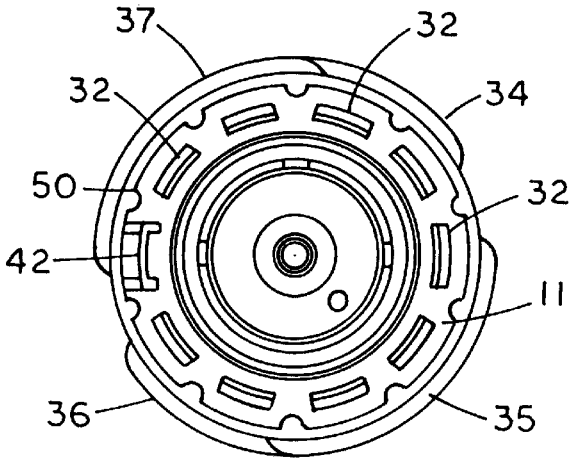
FIG. 7 is a bottom view thereof.
Figure 10:
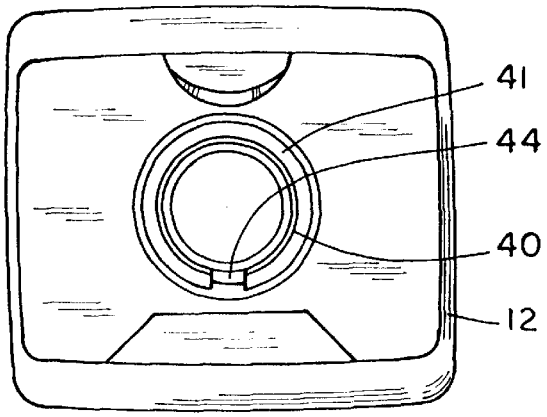
FIG. 10 is a top plan view of the bottle shown in FIGS. 8 and 9.
Figure 8:
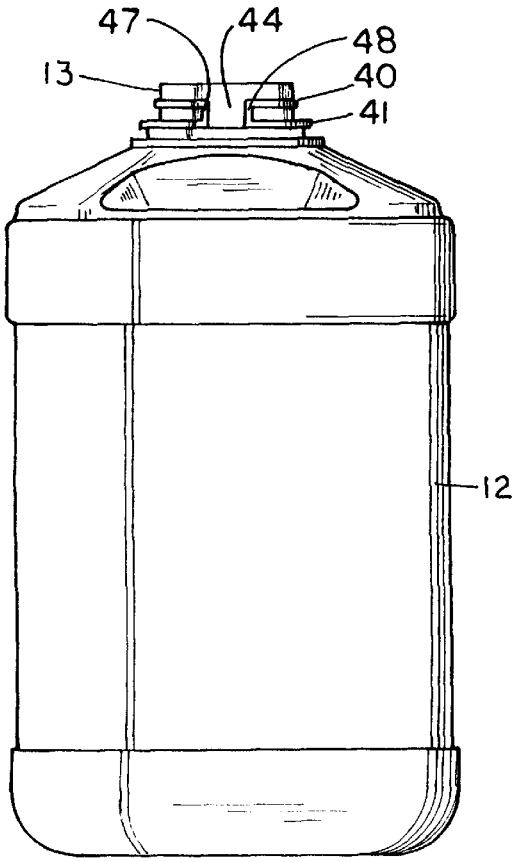
FIGS. 8 and 9 are front and side elevational views, respectively, of the bottle for use with the dispensing bottle closure of this invention.
Figure 9:
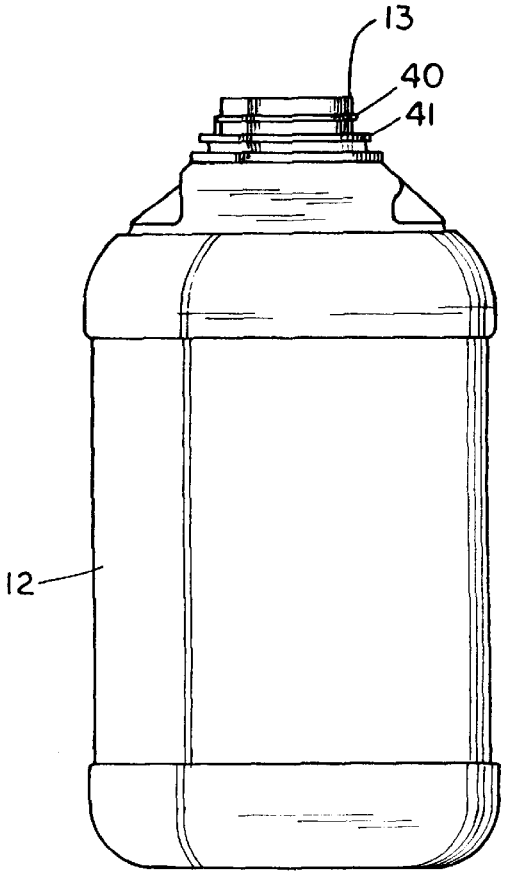

As seen in FIG. 7 as well as FIGS. 1 and 2, there are a plurality of flexible fingers 32 which extend from the underside of the cap 11. Fingers 32 have flange sections 38 for engagement with the rib 40 on the neck 13 of the bottle 12. There is also a guide projection 42 extending from the underside of the cap 11 for orientation with guide slot 44 on the neck 13. The guide slot 44 is also seen in FIGS. 8 and 10. This guide slot 44 is formed between the rib 40 and the shoulder 41 by the ribs 47 and 48. Rib 40 and shoulder 41 extend circumferentially around neck 13 except in the area of the guide slot 44. This is indicated in FIGS. 9 and 10.

Figure 4:
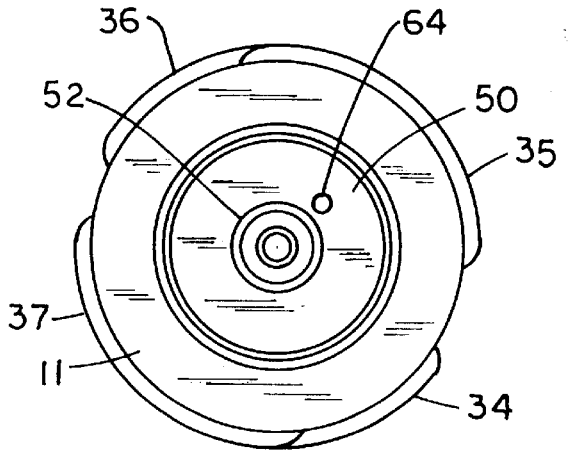
FIG. 4 is a top plan view of the dispensing bottle closure.
Figure 5:
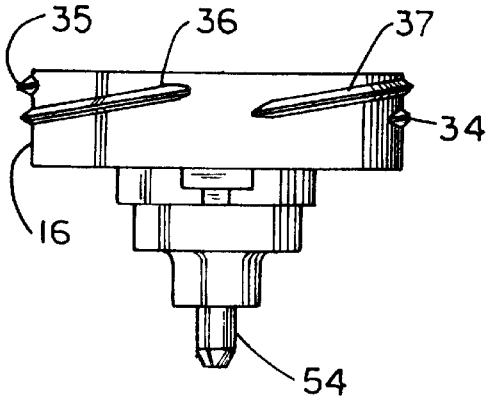
FIG. 5 is a side elevational view thereof.
Figure 6:
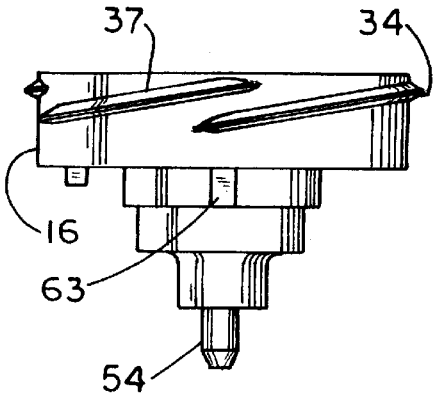
FIG. 6 is a view similar to FIG. 5 with the closure turned 90°.

Referring to FIGS. 4, 5, and 6, it is seen that there are four threaded portions 34, 35, 36, and 37 which extend from side wall 16 and circumferentially around the outside of the plug 11. These provide a threaded attachment to threads such as 88 in a filling head 20 as shown in U.S. Pat. No. 5,862,948.

An important aspect of the invention is the placement of the plug 11 on the bottle 12 to afford a threaded connection such as by the thread portions 34–37. This eliminates having to hold close tolerances when manufacturing the bottle and obviates having to ship empty bottles from a location where close tolerances need to be held. Instead, the tolerances can be maintained in the cap and the cap shipped from a location where close tolerances are maintained and then later connected to the bottle.

It will also be seen that a secure connection between the plug 11 and bottle 12 is afforded not only by the engagement of fingers 32 on rib 40 but by the guide assembly composed of guide portion 42 and slot 44 with placement of the guide projection 42 in slot 44. This prevents rotation of the plug on the bottle. It also serves to orientate the threads with the bottle.

Not only does the plug 11 afford a connecting mechanism between a bottle and another device, it also affords a valving function as afforded by the valve assembly 20. As previously indicated, this valve assembly is for use with a filling head 20 as described in U.S. Pat. No. 5,862,948. The valve assembly operates in the same manner as described for valve plunger 124 in the '948 patent. This valve assembly allows for both filling a product into the bottle as well as a metering of product from the bottle as described in conjunction with FIGS. 17*a*–17*c* in the '948 patent. Vent slots 63 are provided for this purpose as shown in FIGS. 1, 2 and 6 as well as a pick up tube 56 connected to nozzle 54. Vent slots 63 provide vent ports when an adjacent section 11*a* of plug 11 is removed to provide passage into core section 18.

Referring to FIG. 2, it should be noted that a sealing bead 65 is disposed in the passage of valve sleeve 24 for sealing against the tubular portion 23 of valve member 22.

The above is considered to be the preferred embodiment of the invention. However, those skilled in the art will appreciate that various changes and modifications can be made without departing from the scope of the invention. For example, while a multiplicity (namely nine) of flexible fingers 32 have been shown for engagement with rib 40. These can vary in number to a minimum of two. Neither is it necessary that flexible fingers and a rib be employed as the frictional engagement members. Instead, a solid flexible bead could be substituted for engagement with rib 40 or a notch provided in the flexible fingers for this purpose. Still further, a partial thread arrangement could be employed. A sealing flap 17 is shown for engaging the side of bead wall 19. Alternatively, a crab claw, bead seal or gasket seal could be substituted to engage the end of bead wall 19. A collar could likewise be employed which engages only a corner portion of the bead wall.

The closure cap of this invention has been illustrated for use in conjunction with a valve assembly. It is obvious that it can be utilized in other applications without the valve assembly 20 where a threaded connection is to be afforded for a bottle. Also, while cap 11 has been illustrated with vent slots 63, these can be eliminated when only an aspiration of product from bottle 12 is required without refilling. In addition, drain port 64 could be eliminated. All such and other modifications within the spirit of the invention are meant to be within its scope as defined by the appended claims.

What is claimed is:

1. A bottle for use with a filling head comprising:

a bottle having a neck portion with a passage therein;

a closure member having a core section constructed and arranged to fit within the passage of the neck portion;

a wall section spaced from the core section;

flexible engagement members positioned between the wall section and core section to provide retention of the closure member in the neck passage;

thread means operatively associated with the wall section; and the wall section and the core section being one piece;

whereby when the closure member is engaged on the neck of the bottle the thread means will provide connection of the bottle to the filling head.

2. The bottle as defined in claim 1 wherein the core section includes a chamber for reception of a valve assembly.

3. The bottle as defined in claim 1 wherein the flexible engagement members are a plurality of flexible finger members having flange sections for engagement with a bar member positioned on the neck portion of the bottle.

4. The bottle as defined in claim 3 wherein the flexible finger members are positioned adjacent the wall section.

5. The bottle as defined in claim 1, further including a guide assembly operatively associated with the wall section and the bottle neck to provide orientation of the threads with respect to the bottle.

6. The bottle as defined in claim 5 wherein the guide assembly includes a slot and a projection so that when the projection is placed in the slot rotation of the closure member with respect to the bottle is prevented.

7. A closure member for use with a bottle and a filling head comprising:

a plug member having a core section constructed and arranged to fit within a passage of the neck portion of a bottle;

a wall section spaced from the core section;

at least one flexible engagement member positioned between the wall section and core section for engagement with at least one frictional engagement member operatively associated with the neck portion of the bottle to provide a retention of the closure member in the neck passage;

thread means operatively associated with the wall section; and the wall section and the core section being one piece;

whereby when the closure member is engaged in the neck of the bottle the thread means will provide connection of the bottle to the filling head.

8. The closure as defined in claim 7 wherein the flexible engagement member is a plurality of flexible finger members having flange sections for engagement with a rib member positioned on the neck portion of the bottle.

9. The closure as defined in claim 8 wherein the flexible finger members are positioned adjacent the wall section.

10. The closure as defined in claim 8 further including a guide assembly operatively associated with the wall section and the bottle neck to provide orientation of the thread means with respect to the bottle.

11. A closure member for use with a bottle and a filling head comprising:

a plug member having a core section constructed and arranged to fit within a passage of the neck portion of a bottle;

at least one frictional engagement member operatively associated with the plug member for engagement with at least one frictional engagement member operatively associated with the neck portion of the bottle to provide a retention of the closure member in the neck passage; the frictional engagement member operatively associated with the plug member and the neck portion being a plurality of flexible finger members having flange sections for engagement with a rib member positioned on the neck portion of the bottle;

a wall section spaced from the core section;

thread means operatively associated with the wall section;

a guide assembly operatively associated with the wall section and the bottle neck to provide orientation of the thread means with respect to the bottle the guide assembly including a groove and a projection so that when the projection is placed in the groove, rotation of the closure member with respect to the bottle is prevented;

whereby when the closure member is engaged in the neck of the bottle the thread means will provide connection of the bottle to the filling head.

* * * * *